United States Patent [19]

Felty et al.

[11] 4,027,468

[45] June 7, 1977

[54] DAY-DATE MECHANISM FOR TRAVEL CLOCK

[75] Inventors: John T. Felty, Tonica; Francis J. Ellerbrock, Peru, both of Ill.

[73] Assignee: General Time Corporation, Mesa, Ariz.

[22] Filed: Oct. 31, 1975

[21] Appl. No.: 627,595

[52] U.S. Cl. ..... 58/4 R; 58/58

[51] Int. Cl.[2] ..... G04B 19/24

[58] Field of Search ..... 58/4, 5, 58

[56] References Cited

UNITED STATES PATENTS

| | | | |
|---|---|---|---|
| 3,451,211 | 6/1969 | Nakagawa | 58/58 |
| 3,668,862 | 6/1972 | Scholz | 58/5 |
| 3,702,530 | 11/1972 | Besson et al. | 58/85.5 |
| 3,775,965 | 12/1973 | Besson et al. | 58/58 |
| 3,818,692 | 6/1974 | Zaugg et al. | 58/58 |
| 3,859,783 | 1/1975 | Wuthrich | 58/58 |
| 3,882,669 | 5/1975 | Takob | 58/58 |

*Primary Examiner*—L. T. Hix
*Assistant Examiner*—Vit W. Miska
*Attorney, Agent, or Firm*—Leydig, Voit, Osann, Mayer & Holt, Ltd.

[57] ABSTRACT

A day-date mechanism which includes an annular "day" ring and an annular "date" ring having adjacent circles of pointed drive teeth and with an associated viewing window for display of day and date side by side. A rotary index pawl coupled to the drive train by a one-way intermittant motion transmitting connection produces an active stroke of movement once every 24 hours. Detent springs for the respective rings engage the drive teeth for completing each step of indexing movement. A manual reset lever is separately engageable with the respective rings for indexing the rings individually into set positions. The nature of the drive connection permits indexing of the rings by the manual reset lever at any time regardless of the position of the index pawl.

4 Claims, 13 Drawing Figures

DAY-DATE MECHANISM FOR TRAVEL CLOCK

It is increasingly common in clocks of all kinds to provide indication of day and date at the clock face, the day and date indicia being located in adjacent positions on a pair of concentric discs for viewing through a window provided in the dial. In the case of a conventional clock intended for constant running the means provided for initially setting the day and date rings is not critical since the setting means is only used at rare intervals. However, in the case of a travel clock which by reason of use requires frequent setting, it is important that the setting means be operable with a maximum of convenience and reliability any time during the 24 hour period. It is also important that the setting means be compact and economical befitting the size and price category of clocks of this type. Moreover, it is important to achieve automatic "throw" of the rings with minimum transition time without imposing high peak loads on the clock drive, particularly considering the limited energy storage available in a compact travel clock or in a watch, to which the invention is also applicable.

It is, accordingly, an object of the present invention to provide a clock in which the day-date indexing mechanism is positive and reliable in operation, with short transition time and with conveniently operated means for separate indexed setting of the day and date. It is a related object to provide a manual reset member which is separately engageable with the day and date rings for indexing them individually into set positions regardless of the phase or condition of the regular indexing mechanism coupled to the clock train. It is a more detailed object to provide a travel clock having day and date rings which are indexable by the drive train in the same direction and which has a single setting arm movable in opposite directions from a neutral position for individual setting of day and date indication.

It is a related object to provide automatic indexing means for day-date display in a small clock which is positive and rapid in operation but which avoids the peak forces, lockup, and related difficulties associated with geneva type stepping mechanisms.

It is a general object of the invention to provide a clock mechanism having automatically indexed display of day and date which is inherently troublefree over the life of the clock and which may be incorporated into a travel clock for enhancement of the value and utility of the clock with only minor modification and expense.

Figure 1:
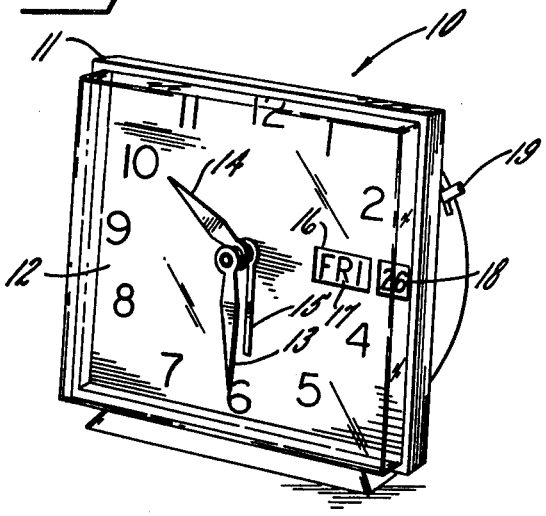

Other objects and advantages of the invention will become apparent upon reading the attached detailed description and upon reference to the drawings in which:

FIG. 1 is a perspective view of a travel clock incorporating the present invention.

Figure 1A:
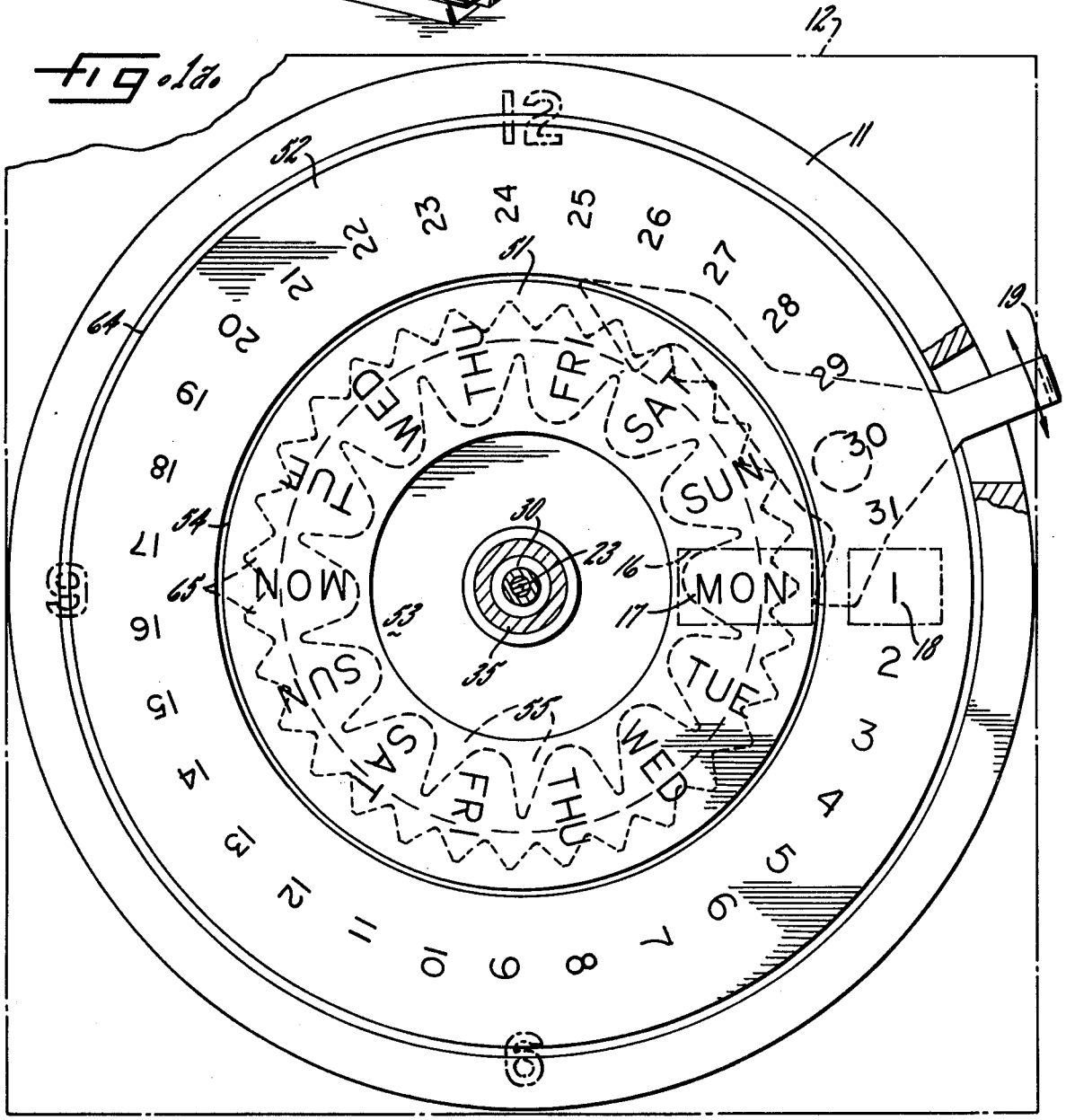
Figures 2, 2A:
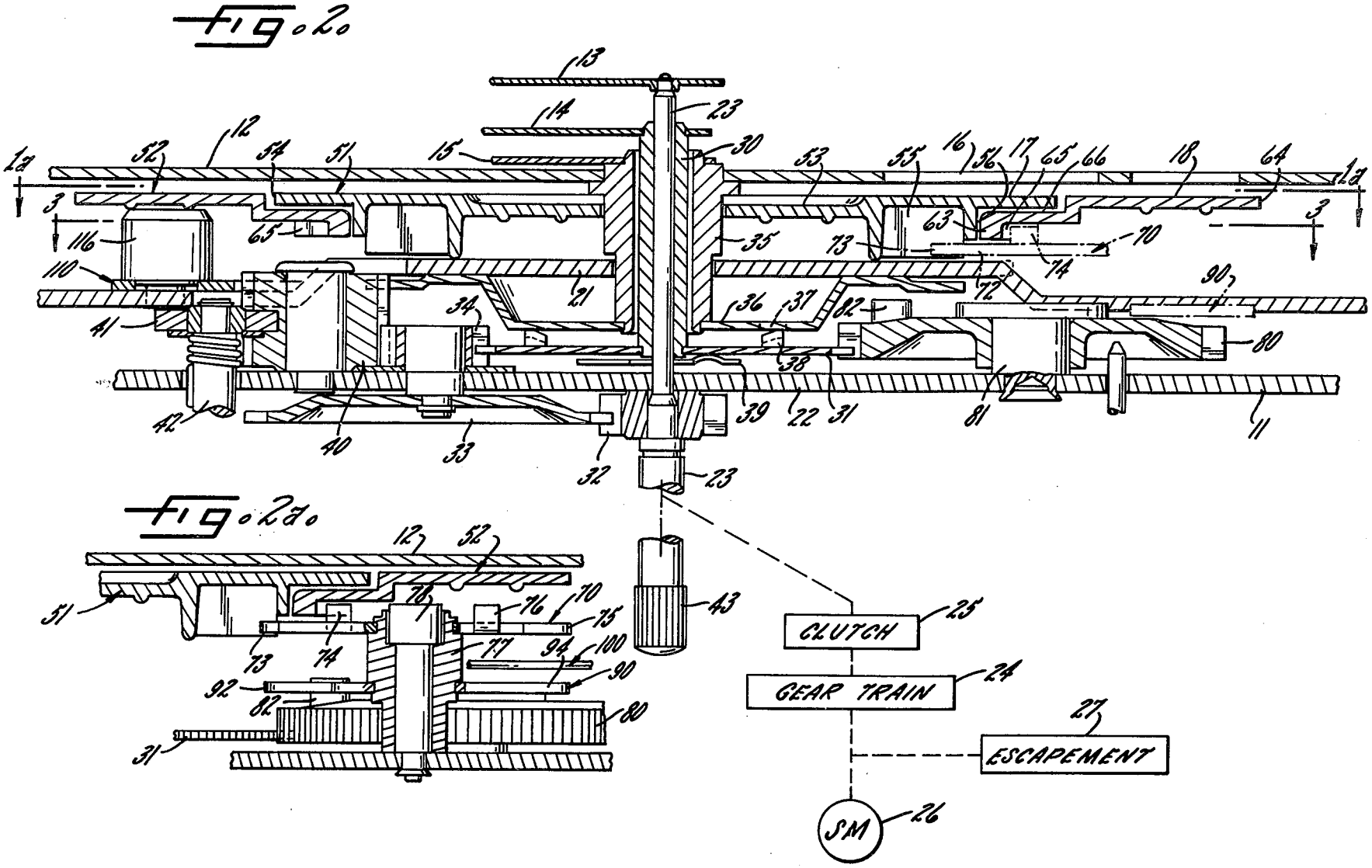

FIG. 1*a* is a face view of the day and date rings looking along the line 1*a*—1*a* in FIG. 2.

Figure 3:
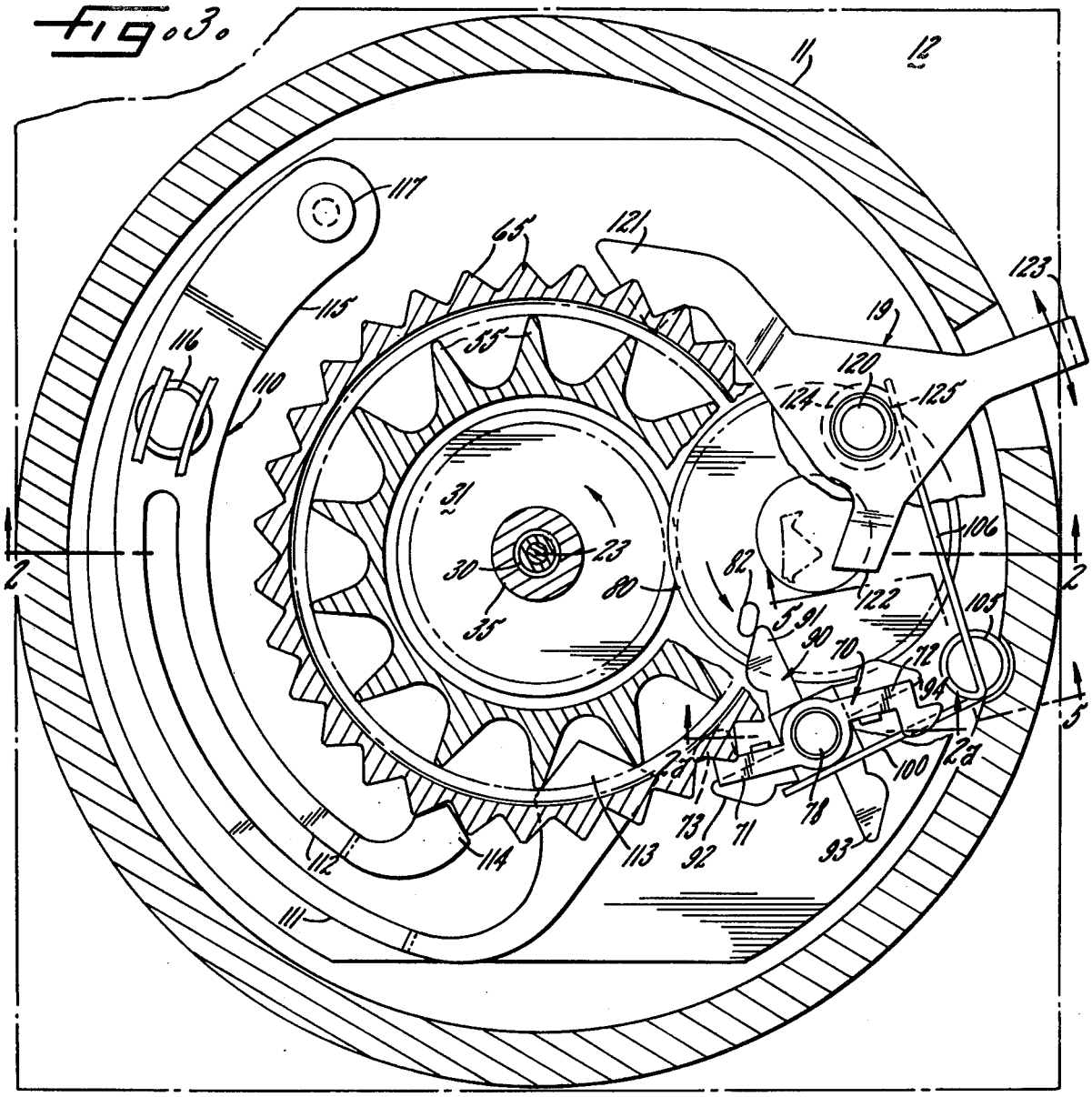

FIG. 2 is a sectional view taken along the line 2—2 in FIG. 3.

FIG. 2*a* is a fragmentary section taken along the line 2*a*—2*a* in FIG. 3.

FIG. 3 is a sectional view looking along the line 3—3 in FIG. 2.

FIGS. 4*a*–4*d* are a set of stop motion views showing the incremental positions of the rings during an active stroke of movement of the index pawl.

Figure 5:
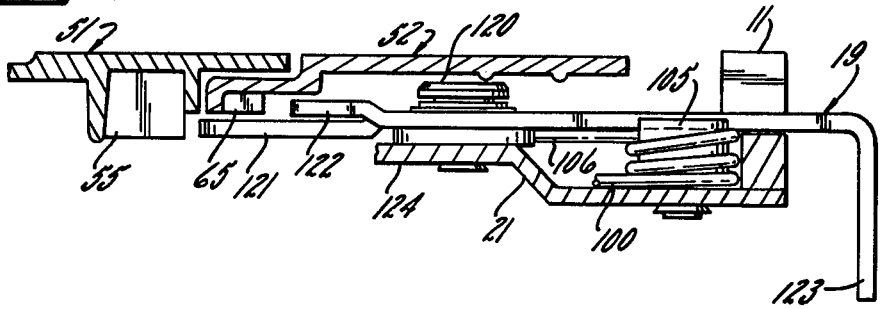

FIG. 5 is a fragmentary section looking along line 5—5 in FIG. 3.

Figure 6A:
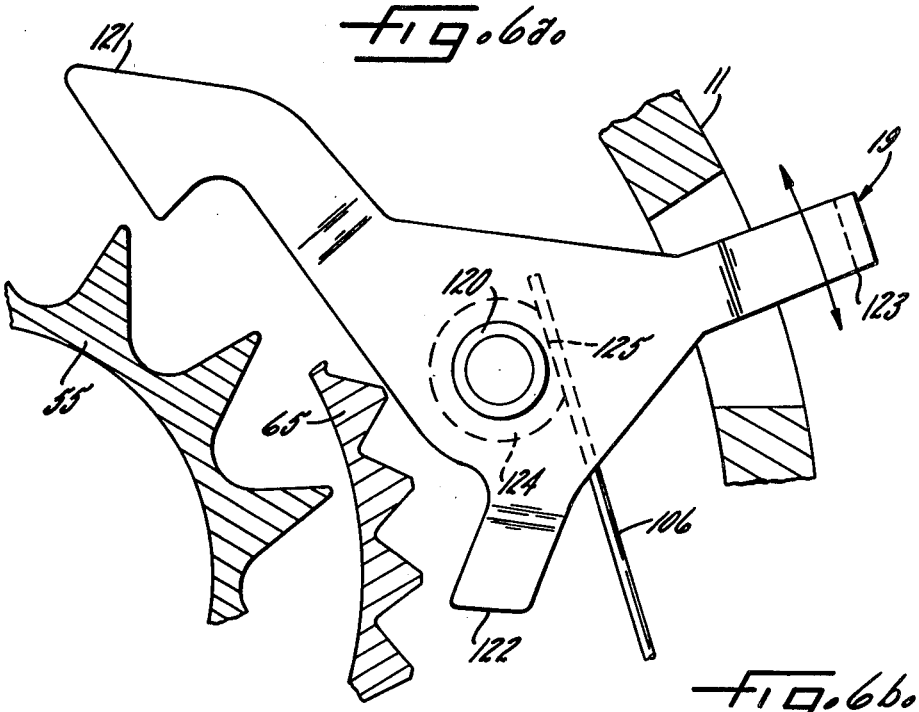
Figure 6B:
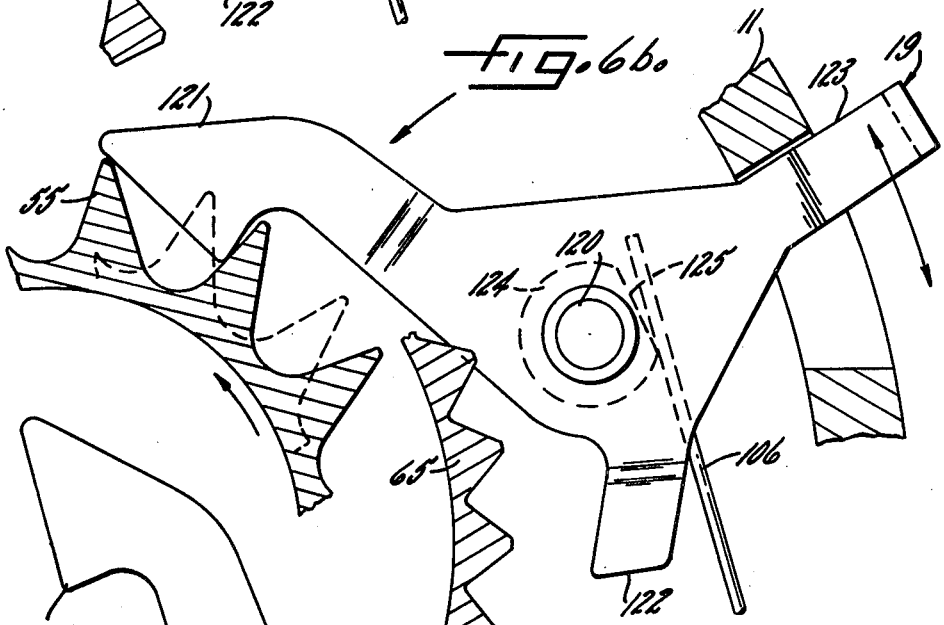
Figure 6C:
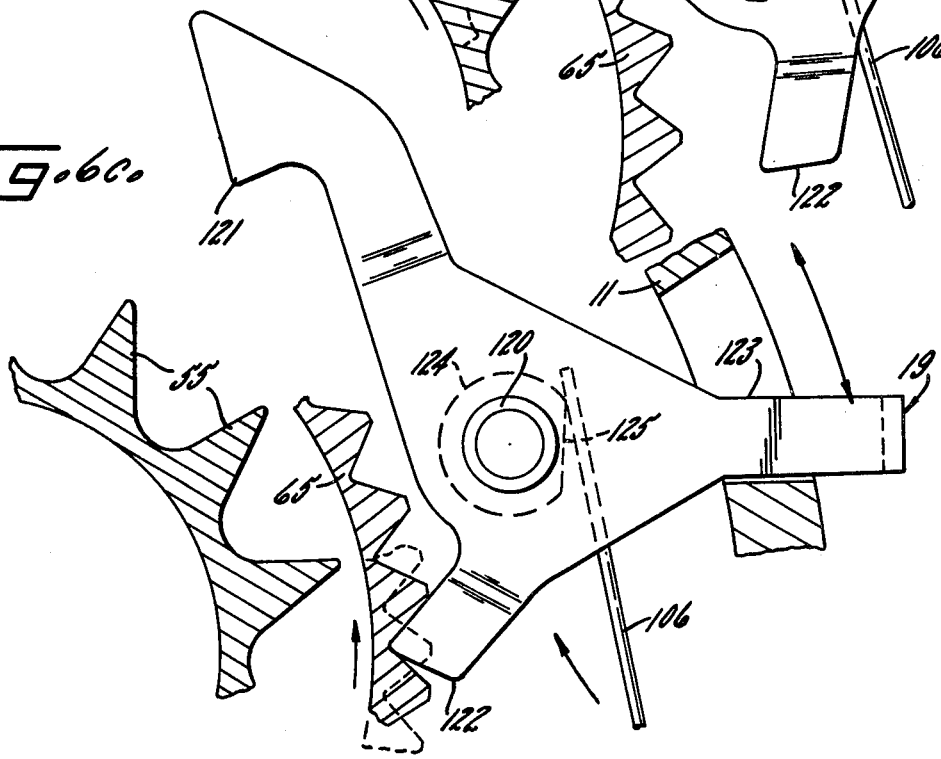

FIGS. 6*a*–6*c* are stop motion views showing the three positions of the manual setting lever and the resulting movement of the day and date rings, respectively.

While the invention has been described in connection with a preferred embodiment, it will be understood that we do not intend to be limited to the preferred embodiment but intend, on the contrary, to cover the various alternative and equivalent forms of the invention included within the spirit and scope of the appended claims.

Turning to the drawings there is shown a travel clock 10 having a frame 11 and dial 12 having the usual minute hand 13, hour hand 14 and alarm setting hand 15. The dial 12 has a window 16 for side-by-side viewing of the day 17 and date 18. A manually operated lever 19 projects from the frame for indexed initial setting of the day and date readings, following which the day and date readings are automatically indexed at 24 hour intervals, preferably at midnight, by the clock drive train, as will be discussed in detail below.

Prior to more detailed reference to the day and date mechanism and display, reference may be first made to FIG. 2 for the purpose of identifying elements which are common to clocks of the present type and which are not per se a part of the present invention. In this figure it will be seen that the frame 11 includes first and second frame plates 21, 22. Extending through the frame for driving the minute hand 13 is a shaft 23 which is driven via a gear train 24 and clutch 25 from a spring motor 26 having an escapement 27, the elements 24–27 being shown only diagrammatically. For the purpose of driving the hour hand 14, a hollow hours shaft 30 is telescoped over the minutes shaft, being staked, at its inner end, to an hours wheel 31. For driving the hours wheel at one-twelfth the speed of the minutes shaft, the latter includes a pinion 32 meshing with a gear 33 having a pinion 34 which, in turn, meshes with the hours wheel 31.

It is conventional in travel type clocks to provide an alarm, and for this purpose the alarm setting hand 15 is connected to a hollow shaft 35 telescoped over the hours shaft, with an indicator wheel 36 staked to its inner end. It will be understood, although not specifically illustrated, that the indicator wheel includes diametrically alined apertures 37 cooperating with a pair of diametrically arranged lugs 38 projecting from the face of the hours wheel and which are biased toward the indicator wheel by a biasing spring 39. For the purpose of setting the phase position of the indicator wheel 36, thereby to set the alarm, an idler pinion 40 is provided having a setting pinion 41 turned by a setting shaft 42. Thus as the hours wheel is slowly rotated by the spring motor under control of the escapement, a set phase position will be reached in which the lugs 38 drop into the apertures 37 producing axial (forward) movement of the hours wheel which is utilized, by means not shown for triggering the sounding of the alarm.

For setting the clock hands a thumb wheel 43 may be coupled, as conventional, to the minutes shaft 23, with manual rotation being accommodated by frictional slippage in the clutch 25.

In carrying out the present invention annular day and date rings of different diameter are concentrically mounted for rotation under the dial 12, the day and date rings having adjacent circles of pointed drive teeth and with a rotary index pawl simultaneously engaging the drive teeth for forward indexing of the rings in the same direction. More specifically in accordance with the invention stepping means including a drive pawl cycled by the gear train and a star wheel in the path of movement thereof are provided so as to produce a oneway intermittent motion transmitting connection with the index pawl thereby to permit manual indexing of the rings, for setting purposes, regardless of the phase of the index pawl. Thus, referring to FIGS. 1*a*, 2 and 3, there is provided an inner or "day" ring 51 and an outer or "date" ring 52 having cycles of indicia as shown in FIG. 1*a*. Referring to the ring 51 in greater detail, it includes a central web portion 53 and a reinforced peripheral portion 54 having an integral set of pointed drive teeth 55 which are in angular register with the day indicia. The day ring includes a smooth circular bearing surface 56 located outwardly of the teeth 55 but of limited axial length so as not to mask the teeth. Riding on the bearing surface 56 is the annular date ring 52 having an inner edge 63, an outer edge 64, and a set of pointed drive teeth 65 which are positioned adjacent the drive teeth 55, and pointing in the same direction, but in a plane which is slightly offset with respect to the teeth 55. The date ring includes an annular recess 66 for receiving, in flush relation, the outer portion 54 of the day ring. Antifriction pads 67 support the rings from the backside.

For the purpose of indexing the day and date rings simultaneously in the forward direction, a rotary index pawl 70 is provided having a pair of diametrically arranged pawl elements 71, 72. The pawl element 71 has adjacent day and date abutments 73, 74 while similar abutments 75, 76 are provided in diametrically opposite position. The abutments 74, 76 extend upwardly, out of the plane of the pawl, so that the pawl is effective at two levels, that is, effective in the adjacent planes occupied by the teeth on the two rings. The radii of the respective abutments are coordinated with the angular "throw" of the rings as will be discussed.

The index pawl is secured to a hub 77 which is rotatable on a stubshaft 78 (see FIG. 2*a*).

For the purpose of producing an active pawl stroke only once every 24 hours (at midnight), a stepping drive is provided between the clock drive train and the index pawl to obtain a one-way intermittent motion-transmitting connection. Such stepping means includes a 12-hour wheel 80 mounted on a stubshaft 81 secured to the frame plate 22 and meshing with the hours wheel 31. Such 12-hour wheel carries on its face a drive pawl 82 which is thereby rotated on a 12-hour cycle. Arranged in the path of movement of the drive pawl 82 is a star wheel 90 which is directly coupled to the index pawl 70, being mounted on the same hub 77, and which has a series of four arms 91–94. Thus every 12 hours, at midnight and noon, one of the arms of the star wheel is engaged by the drive pawl 82, advancing the star wheel and the index pawl 70 which is secured to it, through a step of forward movement. Because of the 1:2 ratio of the arms of the index pawl as related to the arms of the star wheel, the time interval is multiplied by two, and the index pawl produces an active stroke against the drive teeth of the day and date wheels only once in a 24 hour period.

In accordance with one of the aspects of the present invention, means are provided for improving the rapidity of "throw, " at the same time insuring that the engaged arm of the star wheel moves beyond the point where it is deposited by the drive pawl, thereby to make certain that the succeeding arm of the star wheel is positioned reliably in the path of movement of the drive pawl for engagement by the latter in its next rotary cycle. This is accomplished by a star wheel motion completing spring 100 which is in the form of a cantilever and which successively engages four flat surfaces 101, 102, 103, 104 which are formed on the hub of the star wheel and which are arranged in "square" formation. The spring 100 is coiled about a pedestal 105, with the end 106 of the spring extending radially therefrom to provide for centering the lever 19 in neutral position as will be discussed.

Figure 4A:
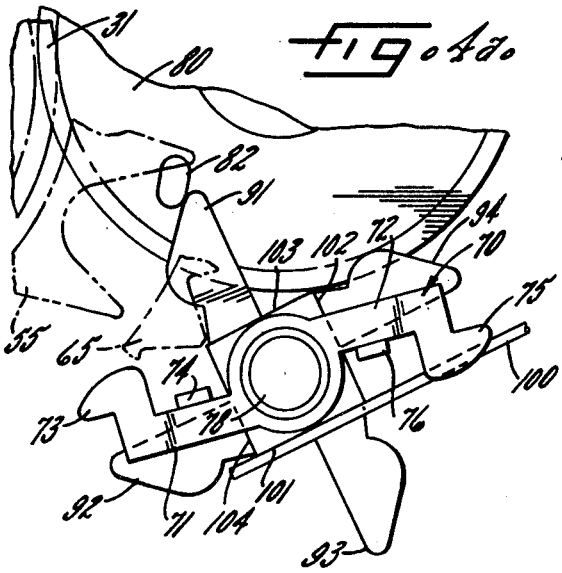
Figure 4B:
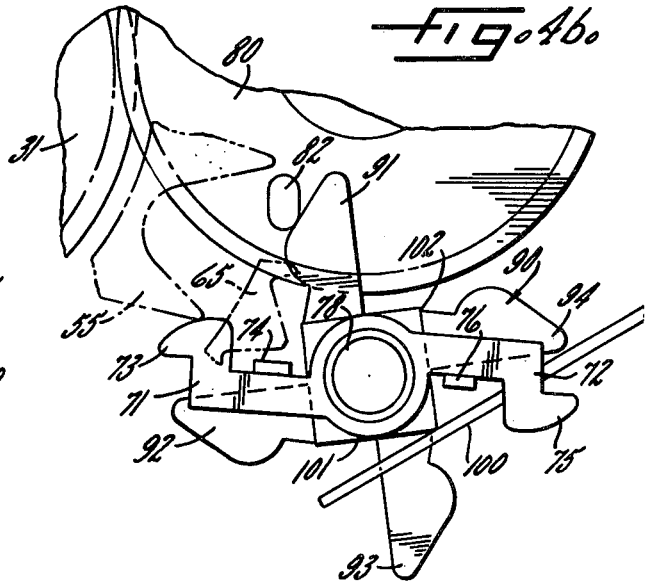
Figure 4C:
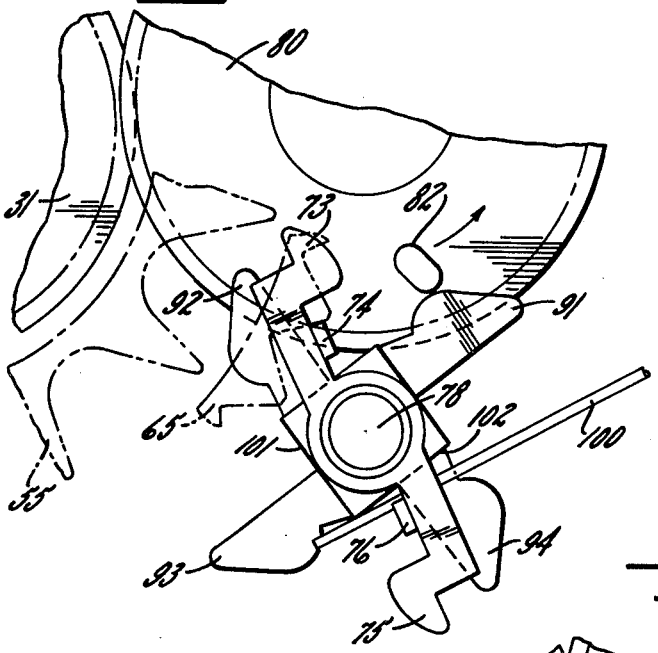
Figure 4D:
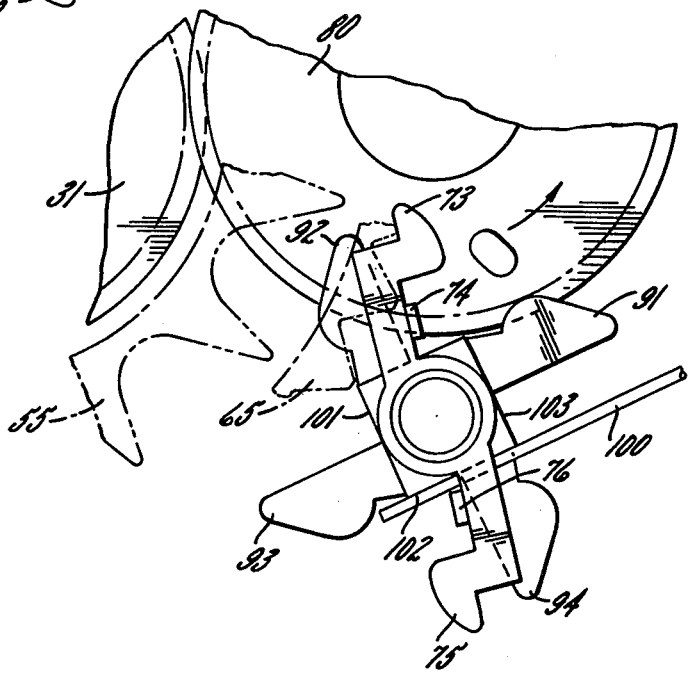

To understand the function of the star wheel and the motion completing spring, reference is made to the series of stop motion views 4*a*–4*d*. In FIG. 4*a* the drive pawl 82 is just beginning to engage the arm 91 of the star wheel, which corresponds to the condition set fourth in FIG. 3. FIG. 4*b* shows the abutments 73, 74 on the index pawl 71 beginning to engage the drive teeth on the day and date wheel respectively and with the spring 100 beginning to be stressed. Continued movement of the index pawl advances the day and date rings forwardly, accompanied by additional stressing of the spring 100, until the spring is over center and until the drive pawl 82 begins to wipe clear of the arm 91, as illustrated in FIG. 4*c*. At this point the motion completing spring 100 takes over, with the spring force, that is, the energy stored in the spring, being effective to cam the star wheel through an additional, motion completing, arc of movement until the spring 100 flattens itself on the surface 102, at which time the tip of the next arm 92 is reliably positioned in the path of movement of the drive pawl 82 for engagement of the latter during its next rotation as shown in FIG. 4*d*. While not illustrated, it will be understood that the next cycle of the drive pawl 82 is an idle one, resulting in 90° advancement of the star wheel but without producing any active stroke of the pawl 70 or any active indexing of the day and date rings. The stroke after that will, however, be an active one with the abutments 75, 76 on the pawl element 72 serving to index the rings.

Not only does the motion completing spring 100 insure that the next arm of the star wheel is deposited in engageable position, but it also insures that the index pawl 70 is deposited in an initial, or rest, position clear of the drive teeth on both of the rings, that is, in a position illustrated in FIGS. 4*a* or 4*d*. This facilitates manual setting to be discussed.

In accordance with one of the further aspects of the invention, motion completing detent springs are provided for both the day and date rings to hold the rings in predetermined indexed positions and for the purpose of achieving snap action in the indexing. In accordance with the invention this is accomplished by a single C-shaped leaf spring member 110 which is split over the major portion of its length to provide resilient spring strips 111, 112 of differing length and which terminate in adjacent planes for engaging the drive teeth on the respective rings. The spring element 111 terminates in a detent 113 while the spring element 112 terminates in a detent 114. Both spring elements have a common base 115 secured to the frame of the clock upon spaced posts 116, 117 thereby to provide a rigid and non-yielding mount.

In accordance with one of the aspects of the present invention the date ring includes a single monthly date while the day ring includes a plurality of day cycles.

Specifically, in order to make the angle of indexing substantially the same for both of the rings, notwithstanding the difference between the number of days in the month and the number of days in a week, a single monthly date cycle consisting of 31 successive date is applied to the date ring 52 and such ring is fitted with a total of 31 registering teeth 65 of pointed configuration. The day ring 51, on the otherhand, has indicia in the form of two successive weekly cycles, with a total of 14 drive teeth 55 registering therewith, 14 teeth being sufficiently close to 31 teeth so that both of the rings may be indexed by the same pawl. The discrepancy in indexing angle is taken care of by the unlike radii of the pawl abutments 73, 74 and 75, 76 and by the motion completing action of the detent spring elements 111, 112 which, in seeking a centered position between adjacent teeth, complete the indexing movement so that both day and date snap into perfectly centered positions within the viewing window 16.

In accordance with one of the aspects of the present invention the manual ring setting lever 19, which is centrally pivoted at 120 is of generally triangular shape having a first arm 121 for engaging the "day" drive teeth 55 and a second arm 122 engaging the "date" teeth 65, as well as a manual operating arm 123 projecting radially from the clock housing. For the purpose of normally maintaining the lever 19 in a centered or neutral position, with the arms 121, 122 safely clear of the drive teeth, the lever is provided with a bushing 124 having a flat 125 which is engaged by the extension 106 of the spring 100. The teeth engaging arms 121, 122 are so shaped as to produce forward advancement of the respective rings, in the same direction, by rocking of the lever 19 in opposite directions. This alternative rocking movement is illustrated in FIGS. *6a–6c*, FIG. *6a* showing the manual setting lever in its neutral position. When the lever 19 is rocked counterclockwise, that is, in the "day" direction, the surface of arm 121, engaging the tip of a presented tooth 55, crowds the tooth in the forward (counterclockwise) direction, with the initial portion of the movement being accompanied by stressing of the motion completing, or detent, spring element 111 until the detent 113 at the end thereof achieves an over center position with respect to the advancing tooth, following which the detent 113 completes the stroke of indexing movement so that the new day is accurately centered within the viewing window. The position of the setting lever at the end of the "day" stroke is illustrated in FIG. *6b*.

Similarly, upon rocking the setting lever 19 in the opposite or clockwise direction for advancement of the date ring, the arm 122 on the setting lever engages the side of the presented tooth 65 on the date ring, with completion of the stroke of setting movement causing the setting lever to occupy the position illustrated in FIG. *6c*. Such movement causes the motion completing or detent spring element 112 to be cammed outwardly, passing over center on the advancing tooth, whereupon the detent 114 takes over, crowding inwardly upon the descending slope of the tooth to complete the counterclockwise indexing movement so that the new date also is perfectly centered in the viewing window. Release of the setting lever 19 causes it to be restored to its neutral or rest position by the spring extension 106 until it is again needed.

It will be understood that as long as the clock continues to run, indexed advancement of the star wheel and index pawl, which is connected to it, will occur in synchronism with the moving of the hands on a 24 hour cycle and with the transition taking place at midnight. While the drive pawl 82 on the 12-hour wheel 80 is driven by the clock train, it will be understood that the 12-hour wheel meshes directly with the hours wheel 31 which is connected to the clock hour hand. This insures that the star wheel is always advanced in 12 hour synchronism with the clock hour hand. Consequently, if the spring motor of the clock should run down, and stop, which is a normal occurrence in travel clocks, the resetting of the hands, by means not shown, will be accompanied by rotation of the 12-hour wheel to retain 12-hour synchronism. Upon resetting the clock, 24 hour synchronism is achieved, if necessary, by rotating the clock hands through a 12 hour interval by the manual hand setting knob.

It is one of the features of the construction that individual manual indexing of the rings is possible at any time regardless of the existing position of the star wheel and index pawl. If the clock happens to stop with the drive pawl 82 out of engagement with one of the arms of the star wheel there is, of course, no problem, since the motion completing spring 100 associated with the star wheel will position the index pawl elements 71, 72 safely clear of the drive teeth on the rings, permitting the latter to be freely indexed by motion of the setting lever in its opposite directions. Because of the 1:1 relationship between the days and dates, and the teeth which drive the same, manual indexing is particularly easy since the lever 19 need only be rocked back and forth between its extremes of movement until the existing day and date are visible in the viewing window. However, in the event that the clock happens to stop with one of the pawl elements 71, 72 in engagement with the drive teeth, that is, with the indexing pawl in the condition illustrated in FIG. *4b*, forward movement of the rings, by manual indexing, simply cams the engaged indexing pawl forwardly (clockwise as viewed in FIG. 3) accompanied by stressing of the motion completing spring 100 and separation of the engaged arm of the star wheel from the pawl 82 which drives it, until a point is reached where the spring 100 is over center, following which the spring will complete the indexing movement of the star wheel thereby causing the index pawl to be free of the drive teeth on the rings so that the teeth may be freely advanced by the manual setting means. This "disengagement"of the star wheel from its driving means is possible due to the one-way intermittent motion transmitting connection which exists between the star wheel and drive train. Thus either ring may be indexed independently, at any time, by cycling the lever 19 between an extreme position and the neutral (central) position. Or, if desired, both rings may be advanced forwardly, in alternating step with one another, keeping the day and date consistent, simply by cycling the lever 19 back and forth between its extreme positions.

It will be apparent that the objects of the invention have been amply carried out. In the first place the automatic indexing provided by the star wheel and index pawl is of absolute reliability, in part by reason of the motion completing action of the star wheel spring 100 which insures that the following arm of the star wheel will always be in the path of movement of the drive pawl. Secondly, notwithstanding the fact that the two rings have slightly different indexing angles, the motion completing detent springs 111, 112 insure that the day and date indicia will always be displayed in accurate, centered position within the viewing window. Moreover, because of the use of the illustrated stepping drive, the disadvantages of a geneva type movement, with its high peak force requirement, are avoided and reliable stepping of the star wheel is achieved with only a limited torque requirement from the spring motor of the clock, thereby permitting the mechanism to be employed with drive springs of small size and limited energy storage capacity. The disclosed setting mechanism is inherently simple, compact and inexpensive, disproportionately contributing to the value of the resulting clock.

What is claimed is:

1. In a clock mechanism having provision for display of day and date, the combination comprising a frame, a drive train having a motor and terminating in minutes and hours shafts, a day ring having "day" indicia and a circle of pointed drive teeth in register therewith, a separate date ring having "date" indicia and a circle of pointed drive teeth in register therewith, the two rings being concentric and of different radius with the indicia thereon progressing the same direction and having a viewing window for display of day and date side by side, a 12-hour wheel coupled to the hours shaft and having a drive pawl thereon, a star wheel having arms in the path of movement of the drive pawl, a detent spring cooperating with the star wheel for causing the same to complete a step of forward indexing when movement is initiated by the drive pawl, an index pawl on the star wheel having arms in a 1:2 ratio with the latter for effecting driving of the index pawl on a 24-hour cycle, the index pawl being positioned to engage the drive teeth on the rings for moving both of the rings forwardly simultaneously followed by movement of the pawl clear of the drive teeth, detent springs for the respective rings anchored in the frame and cooperating with the drive teeth to complete a step of forward indexing when movement is initiated by the index pawl, and reset means alternately engageable with the respective rings for manually indexing the rings forwardly step by step with one another into set positions.

2. The combination as claimed in claim 2 in which the detent springs for the respective rings are combined in a C-shaped spring member, the latter having provision for anchoring to the frame at one end and split over the major portion of its length into separately movable resilient strips of differing length terminating in adjacent planes for detentedly engaging the drive teeth on the respective rings.

3. In a clock mechanism having provision for display of day and date, the combination comprising, a frame, a drive train having a motor and terminating in minutes and hours shafts, a day ring having "day" indicia and a circle of pointed drive teeth in register therewith, a separate date ring having "date" indicia and a circle of pointed drive teeth in register therewith, the two rings being concentric and of different radius with the indicia thereon progressing in the same direction, a viewing window for display of day and date side by side, a rotary index pawl, means for coupling the index pawl to the drive train for stepped rotation once every 24 hours, the index pawl being oriented to engage the drive teeth on both of the rings for moving the rings forwardly with simultaneous movement, means including a manual reset member alternately engageable with the drive teeth for individually moving the rings forwardly step by step with one another toward respective set positions, and detent springs for the respective rings anchored to the frame and cooperating with the drive teeth to complete a step of forward indexing when movement thereof is initiated either by the index pawl or by the manual reset member.

4. In a clock mechanism having provision for display of day and date, the combination comprising a frame, a dial, a drive train having a motor at the input and having minutes and hours shafts at the output, an annular day ring having "day" indicia and a circle of pointed drive teeth in register therewith, a separate date ring having "date" indicia and a circle of pointed drive teeth in register therewith, the two rings being concentric in a different radius with the indicia thereon progressing in the same direction and having a viewing window for display of day and date side by side, a rotary index pawl, stepping means for advancing the index pawl so as to produce an active stroke of movement of the index pawl at midnight once every 24 hours, the index pawl being positioned to cooperate with the drive teeth on the rings for indexing the rings simultaneously in the forward direction, motion completing means for causing the index pawl to move clear of the drive teeth upon completion of a stroke of indexing movement, a centrally pivoted manual indexing lever lockable between limit positions and having first and second arms for engaging a drive tooth on the respective rings at the respective limits of movement for imparting thereto a step of indexing movement, detent springs for the respective rings anchored to the frame and cooperating with the drive teeth for completing each step of indexing movement so that when the reset lever is manually oscillated back and forth between its limit positions the day and date rings are alternately indexed forwardly step by step for advancement to set position in unison with one another.

* * * * *